US009532596B2

(12) United States Patent
Takeuchi et al.

(10) Patent No.: US 9,532,596 B2
(45) Date of Patent: Jan. 3, 2017

(54) PACKAGE FOR ORAL TOBACCO PRODUCT AND THE ORAL TOBACCO PRODUCT

(71) Applicant: JAPAN TOBACCO INC., Tokyo (JP)

(72) Inventors: Manabu Takeuchi, Tokyo (JP); Norio Kawata, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 449 days.

(21) Appl. No.: 14/041,861

(22) Filed: Sep. 30, 2013

(65) Prior Publication Data

US 2014/0027325 A1 Jan. 30, 2014

Related U.S. Application Data

(63) Continuation of application No. PCT/JP2011/058252, filed on Mar. 31, 2011.

(51) Int. Cl.

| | |
|---|---|
| ***B65D 81/26*** | (2006.01) |
| ***B65D 85/10*** | (2006.01) |
| ***A24F 23/02*** | (2006.01) |
| ***A24F 23/00*** | (2006.01) |
| ***B65D 81/32*** | (2006.01) |

(52) U.S. Cl.

CPC ..... *A24F 23/02* (2013.01); *A24F 23/00* (2013.01); *B65D 81/3238* (2013.01)

(58) Field of Classification Search

CPC ..... B65D 81/3238; A24F 23/00; A24F 23/02

USPC 206/242, 248, 260, 264, 204, 222; 131/274, 275, 300

See application file for complete search history.

(56) References Cited

U.S. PATENT DOCUMENTS

| | | | | |
|---|---|---|---|---|
| 3,382,020 | A * | 5/1968 | Meri | A24F 25/02 312/223.6 |
| 5,607,051 | A * | 3/1997 | Espinosa | A24F 25/00 206/213.1 |
| 5,850,839 | A * | 12/1998 | Adami | A24F 25/00 131/274 |
| 8,931,711 | B2 * | 1/2015 | Gruenbacher | A01M 1/2033 220/501 |
| 2004/0178088 | A1 * | 9/2004 | Zonker | B65D 7/04 206/242 |
| 2007/0062549 | A1 | 3/2007 | Holton, Jr. et al. | |
| 2007/0186941 | A1 | 8/2007 | Holton, Jr. et al. | |
| 2008/0029110 | A1 | 2/2008 | Dube et al. | |

(Continued)

FOREIGN PATENT DOCUMENTS

| | | | |
|---|---|---|---|
| JP | 2008-94409 | A | 4/2008 |
| JP | 2009-508523 | A | 3/2009 |

(Continued)

OTHER PUBLICATIONS

Extended European Search Report issued in corresponding European Patent Application No. 11862533.4 on Jun. 8, 2015 (5 pages in English).

*Primary Examiner* — Luan K Bui

(74) *Attorney, Agent, or Firm* — Birch, Stewart, Kolasch & Birch, LLP

(57) ABSTRACT

A package for an oral tobacco product is a package that houses a pouch P including tobacco microparticles made of a tobacco raw material and a packaging material for packaging the tobacco microparticles and configured to cause, when being put in an oral cavity of a user, the user to absorb a tobacco component of the tobacco microparticles, the package including, in the inside thereof, a liquid storing section 24 in which liquid to be supplied to the pouch is stored.

3 Claims, 13 Drawing Sheets

(56) References Cited

U.S. PATENT DOCUMENTS

| | | | | |
|---|---|---|---|---|
| 2008/0314518 | A1* | 12/2008 | Sutter | C09J 4/00 156/331.7 |
| 2009/0025738 | A1 | 1/2009 | Mua et al. | |
| 2009/0025739 | A1 | 1/2009 | Brinkley et al. | |
| 2009/0057173 | A1* | 3/2009 | Mitten | A24F 23/00 206/256 |
| 2009/0301504 | A1* | 12/2009 | Worthen | A23L 1/22008 131/274 |
| 2010/0018883 | A1 | 1/2010 | Patel | |
| 2011/0061666 | A1 | 3/2011 | Dube et al. | |
| 2011/0180621 | A1* | 7/2011 | Gruenbacher | A61L 9/127 239/34 |
| 2011/0232656 | A1* | 9/2011 | Zeng | A23L 1/22016 131/275 |
| 2011/0315154 | A1 | 12/2011 | Mua et al. | |
| 2012/0073590 | A1 | 3/2012 | Kawata et al. | |
| 2014/0069829 | A1* | 3/2014 | Evans | A24F 23/02 206/265 |

FOREIGN PATENT DOCUMENTS

| | | | |
|---|---|---|---|
| JP | 2011-4 | A | 1/2011 |
| WO | WO 2008/148702 | A1 | 12/2008 |
| WO | WO 2010/147025 | A1 | 12/2010 |

* cited by examiner

PACKAGE FOR ORAL TOBACCO PRODUCT AND THE ORAL TOBACCO PRODUCT

This application is a CON of PCT/JP2011/058252 filed on Mar. 31, 2011.

BACKGROUND OF THE INVENTION

Field of the Invention

The present invention relates to a package for an oral tobacco product that absorbs a tobacco component via saliva and to an oral tobacco product.

Description of the Related Art

As a tobacco product that a user can imbibe irrespective of places such as in a plane and in a train, there is SNUFF with which the user puts treated tobacco microparticles in the oral cavity, the nasal cavity or the like and directly absorbs a tobacco component from the mucous membrane while enjoying the flavor.

In recent years, SNUS has attracted attention because, in order to improve easiness to use and a sense of use, it allows a user to hold tobacco microparticles in the oral cavity in a pouch form obtained by packaging the tobacco microparticles with a packaging material such as nonwoven fabric (see, for example, Patent document 1). The user (a consumer) holds a tobacco packaging body (in general, referred to as a pouch), which is put in the oral cavity, between the upper lip and the gum to absorb a tobacco component extracted to the saliva into the body from the gum while enjoying flavor thereof.

[Patent document 1] Japanese Patent Laid-Open No. 2011-4

[Patent document 2] International Publication Pamphlet No. WO 2008/148072

SUMMARY OF THE INVENTION

However, the SNUS has a problem in that the SNUS is sticky and poor in fluidity because the SNUS is in a high water content state (usually, an amount of moisture is about 30 to 60%) in which a region of an amount of moisture (a moisture content) suitable for a use form of the product is relatively large, in order to produce the pouch in this moisture amount region, a pre-treatment process for pressing and hardening tobacco cuts and the like is necessary, and a sense of use is damaged because the tobacco cuts are pressed and hardened.

There is also used a method of adding water to the surface of a pouch manufactured in a low water content state in which an amount of moisture is relatively small, adjusting the amount of moisture to a desired amount of moisture, and shipping the pouch. However, there is a concern that the pouch is colored by seepage of a tobacco component in a distribution process for distributing the product and the quality of external appearance is damaged. Further, in order to distribute the SNUS in the high water content state while maintaining quality, it is necessary to arrange a low-temperature storage facility such as a refrigerator in a distribution route of the product. Therefore, another problem could occur in that this leads to an increase in distribution costs of a tobacco product.

Therefore, in some cases, the SNUS manufactured in the low water content state in which treatment in a manufacturing process is easy and low-temperature distribution is unnecessary is directly provided to a consumer. However, in this case, the fact is that emission of flavor and a sense of use are deteriorated.

The present invention has been devised in view of the above-described problems and it is an object of the present invention to provide, concerning an oral tobacco product, a technique that can suppress damage to the quality of the oral tobacco product such as an external appearance, a sense of use, and emission of flavor during provision to a user even if the oral tobacco product is based on manufacturing of a tobacco packaging body (a pouch) in a low water content state in which treatment during manufacturing and during distribution is easy.

In order to solve the above-described problems, the present invention is a package that houses a tobacco packaging body including tobacco microparticles made of a tobacco raw material and a packaging material for packaging the tobacco microparticles and configured to cause, when being put in an oral cavity of a user, the user to absorb a tobacco component of the tobacco microparticles, the package including, in the inside thereof, a liquid storing section in which liquid to be supplied to the tobacco packaging body is stored.

The present invention can be grasped as an aspect of an oral tobacco product including the package and the tobacco packaging body (the pouch). That is, the oral tobacco product according to the present invention includes the tobacco packaging body including the tobacco microparticles made of the tobacco raw material and the packaging material for packaging the tobacco microparticles and configured to cause, when being placed in the oral cavity of a user, the user to absorb a tobacco component of the tobacco microparticles through saliva, the package configured to house the tobacco packaging body, and the liquid storing section in which liquid to be supplied to the tobacco packaging body is stored.

In the package according to the above-described configuration, the liquid storing section is independently provided separately from a housing space for the tobacco packaging body in the inside of the package. The liquid storing section is configured using a water impermeable material. In the liquid storing section, water, a solution obtained by adding and dissolving perfume and other additives in a solvent such as water (hereinafter referred to as perfume liquid), or the like is stored by a predetermined amount. A stored amount of the liquid stored in the liquid storing section is desirably set as, for example, an amount necessary for adjusting an amount of moisture of the tobacco packaging body (the tobacco microparticles) to a target value (e.g., about 30 to 60%).

According to the present invention, when taking out the tobacco packaging body housed in the inside of the package, the user can, for example, crush the liquid storing section beforehand to supply the liquid stored in the inside of the liquid storing section to the tobacco packaging body (the tobacco microparticles) and cause the liquid to penetrate into the tobacco packaging body. Therefore, with this configuration, when holding the tobacco microparticles (SNUS) in the mouth to enjoy flavor, the user can easily increase the amount of moisture thereof.

Therefore, during manufacturing of the tobacco packaging body, since the tobacco packaging body can be manufactured in the low water content state, it is possible to improve production efficiency thereof. Further, since seepage of the tobacco component to the packaging material is suppressed because of the low water content state, it is possible to prevent an appearing impression from being deteriorated. Further, it is unnecessary to particularly perform treatment for pressing and hardening the tobacco microparticles during manufacturing. Therefore, it is possible to prevent a sense of use from being deteriorated when the user holds the tobacco microparticles in the mouth.

The tobacco microparticles can be directly shipped and distributed in the low water content state. Therefore, it is unnecessary to dispose a cooling facility in a distribution route of the tobacco microparticles, and it is possible to reduce distribution costs for the oral tobacco product.

When the oral tobacco product in which the tobacco packaging body in the low water content state is housed as described above is provided to the user, the user can cause the liquid stored in the liquid storing section to penetrate into the tobacco packaging body (the tobacco microparticles) as described above and hold the tobacco packaging body in the mouth after easily increasing the amount of moisture thereof. That is, the user can take in the tobacco component extracted from the tobacco microparticles after changing the tobacco packaging body from the low water content state to a high water content state. As a result, since time duration until emission of flavor is shortened, it is possible to improve satisfaction of the user.

The package according to the present invention may further include an opening assisting section for assisting opening of the liquid storing section by the user. Consequently, the user can more easily open the liquid storing section and pour the liquid stored in the inside of the liquid storing section into the tobacco packaging body (the tobacco microparticles). Therefore, it is possible to provide the package convenient for the user.

The package according to the present invention may include a plurality of the liquid storing sections. By providing the plurality of liquid storing sections independently in this way, the user can adjust an amount of the liquid (water, the perfume liquid, etc.) supplied to the tobacco microparticles.

Consequently, a degree of freedom increases when the user adjusts the amount of moisture of the tobacco packaging body (the tobacco microparticles), and it is possible to adjust the time duration until emission of flavor from the tobacco microparticles according to preference.

As described above, when the plurality of liquid storing sections are provided in the package, a plurality of the opening assisting sections respectively corresponding to the respective liquid storing sections are desirably provided. Consequently, irrespective of which of the liquid storing sections the user opens, work for the opening is easy.

When the plurality of liquid storing sections are provided in the package, water may be stored in at least one of the plurality of liquid storing sections and the perfume liquid obtained by dissolving perfume in a solvent may be stored in at least one of the remaining liquid storing sections. Consequently, the user can freely select a target to be opened according to preference or a mood at that time, for example, select whether the liquid storing section in which water is stored is opened, whether the liquid storing section in which the perfume liquid is stored is opened, or whether both the liquid storing sections are opened. For example, if the liquid storing section in which water is stored is opened, it is possible to increase only the amount of moisture of the tobacco packaging body (the tobacco microparticles). If the liquid storing section in which the perfume liquid is stored is opened, it is possible to increase the amount of moisture of the tobacco packaging body and, in addition, arrange flavor of the tobacco microparticles.

As described above, according to the present invention, the user can finely adjust both of the amount of moisture and the flavor of the tobacco packaging body (the tobacco microparticles) according to preference of the user. Therefore, according to the present invention, it is possible to provide the oral tobacco product with extremely high satisfaction of the user. Therefore, it is possible to improve a commercial value of the oral tobacco product.

Note that the means for solving the problems in the present invention can be adopted in combination as much as possible.

According to the present invention, concerning the oral tobacco product, it is possible to suppress damage to the quality of the oral tobacco product such as an external appearance, a sense of use, and emission of flavor during provision to a user even if the oral tobacco product is based on manufacturing of a tobacco packaging body in a low water content state in which treatment during manufacturing and during distribution is easy.

DESCRIPTION OF THE EMBODIMENTS

An oral tobacco product and a package applied to the oral tobacco product according to the present invention are described below with reference to the drawings.

First Embodiment

Figure 1:
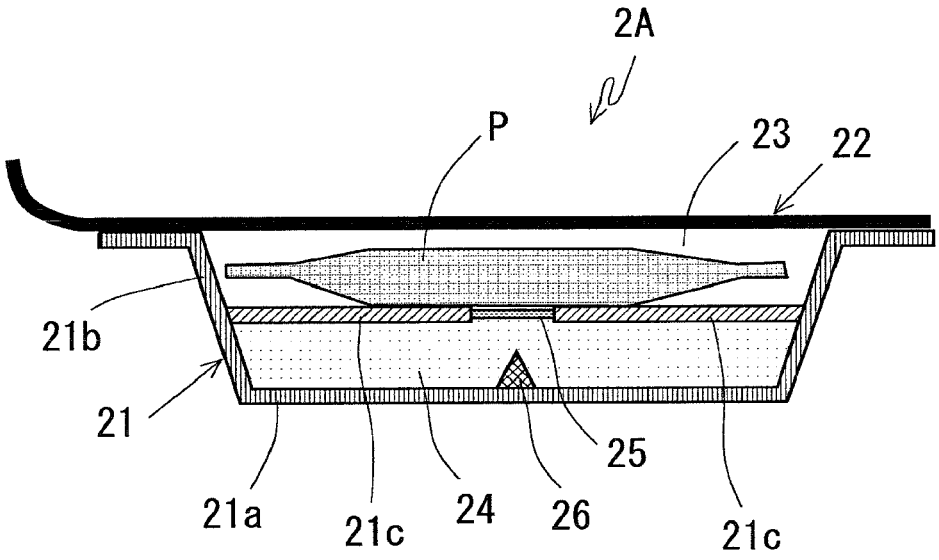
FIG. 1 is a schematic configuration diagram schematically illustrating a first package related to an oral tobacco product.

FIG. 1 is a schematic configuration diagram schematically illustrating a sectional shape of a package for an oral tobacco product according to a first embodiment. An oral tobacco product 1 includes a pouch P (a tobacco packaging body) and an openable and closable package 2A configured to house the pouch P.

The pouch P is obtained by packaging, with a packaging material such as a nonwoven fabric sheet, SNUS, which is cuts, i.e., tobacco microparticles having a particle diameter of, for example, several millimeters or less obtained by processing a tobacco raw material after cutting or grinding the tobacco raw material. The pouch P has a size of, for example, about 20 to 40 mm lengthwise and 10 to 20 mm widthwise. The shape and the size of the pouch P are not limited to particular shape and size, and various shapes and sizes can be adopted.

The SNUS in the pouch P is adjusted to an amount of moisture of, for example, about 12 to 15%. The pouch P is taken out from the package 2A, placed in the oral cavity of a user, and absorbed by the user via the mucous membrane. Specifically, the pouch P is held between the upper lip and the gum and a tobacco component extracted into the saliva from the SNUS is absorbed into the body from the gum.

The package 2A is a resin container of a so-called blister type. The package 2A includes a container main body 21 and an opening seal (cover) 22 that can open and close the inside of the container main body 21. A housing space 23 for the pouch P, a water storing section (a storing section) described below, and the like are formed in the inside of the package 2A. The container main body 21 is a concave section formed in a tray shape in which the pouch P is housed. The container main body 21 includes an opening portion opened in the upper side thereof. The opening seal 22 closes the opening portion of the container main body 21. The container main body 21 is usually made of plastic formed in vacuum. However, the container main body 21 can be made of any suitable material such as metal, paper, and a combination of metal and paper.

The opening seal 22 is stuck to an upper opening portion of the container main body 21 to maintain the inside of the package 2A in a sealed state. When the opening seal 22 is peeled by the user, an internal space of the package 2A is opened to the outside.

In a configuration example illustrated in FIG. 1, a partition wall 21*c* extending from a sidewall 21*b* is provided to be opposed to a bottom wall 21*a* of the container main body 21. A liquid storing section 24 is formed by a closed space defined by the bottom wall 21*a*, the sidewall 21*b*, and the partition wall 21*c*. The liquid storing section 24 is configured using an impermeable material. Predetermined liquid is stored in the inside of the liquid storing section 24. In this embodiment, the liquid storing section 24 is filled with a predetermined amount of water during manufacturing of the package 2A. In this embodiment, as the impermeable material forming the liquid storing section 24, for example, polyvinyl chloride, polypropylene, polystyrene, polyethylene terephthalate (including amorphous), biodegradable polymer, and the like can be suitably used.

The partition wall 21*c* includes in a part thereof a cleaving section 25 formed thinner than the other portion (hereinafter referred to as general portion as well) to be more easily cleaved than the general portion. In the example illustrated in FIG. 1, the cleaving section 25 is provided near the center portion in the partition wall 21*c*. On the other hand, a protrusion for cleavage 26 having a sharp tip upward is provided near the center portion in the bottom wall 21*a* in the container main body 21. The protrusion for cleavage 26 is arranged below the liquid storing section 24, i.e., in a position opposed to the cleaving section 25 across the liquid storing section 24. As is evident from FIG. 1, a tip portion of the protrusion for cleavage 26 and the cleaving section 25 are separated in an initial state.

As illustrated in the figure, one or more of pouches P are placed on the partition wall 21*c* in the container main body 21. In this embodiment, one pouch P is placed on the partition wall 21*c*. Consequently, the internal space of the package 2A in this embodiment is formed in a two-layer structure divided into upper and lower parts. In the example illustrated in FIG. 1, the liquid storing section 24 is formed on the bottom side of the container main body 21. A housing space (hereinafter referred to as pouch housing space) 23 for the pouch P is formed above the liquid storing section 24 across the partition wall 21*c*.

Note that the general portion in the partition wall 21*c* is designed to have rigidity enough for not being largely bent or excessively deformed even if the pouch P is placed thereon as described above. In this embodiment, in the container main body 21, the shape of the bottom wall 21*a* is formed in a substantially rectangular shape. However, the shape may be other shapes, for example, a circular shape, a polygonal shape or the like, and is not limited to a specific shape.

As the opening seal 22 for opening and closing the pouch housing space 23 of the package 2A, various configurations can be adopted as long as the opening seal 22 is a lid member that can generally seal the pouch housing space 23 until the package 2A is provided to the user and easily open the pouch housing space 23 when the user takes out the pouch P.

An adhesive of the opening seal 22 may be a re-peeling type that can be stuck and peeled many times or may be a general type that cannot be re-peeled. In this embodiment, since the single pouch P is housed in the pouch housing space 23, the general type is adopted. However, the opening seal 22 of the re-peeling type may be adopted. When a plurality of the pouches P are housed in the pouch housing space 23, it is preferable to adopt the opening seal 22 of the re-peeling type.

Figure 2:
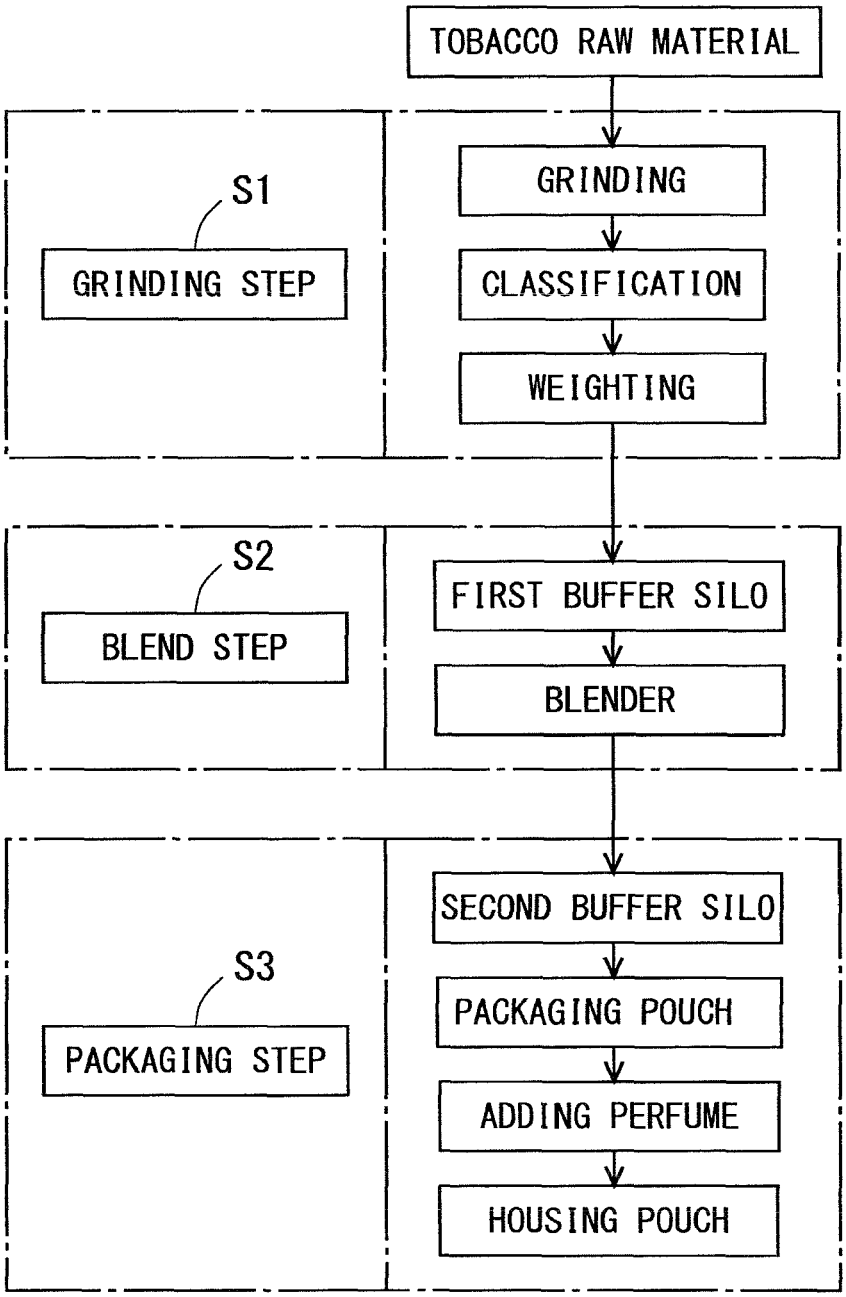
FIG. 2 is a block diagram illustrating a manufacturing process for the oral tobacco product.

Next, an example of a manufacturing process for the oral tobacco product 1 is described on the basis of FIG. 2. FIG. 2 is a block diagram illustrating the manufacturing process for the oral tobacco product 1. As illustrated in FIG. 2, the oral tobacco product 1 is manufactured through a grinding step S1, a blend step S2, and a packaging step S3. Note that the manufacturing process for the oral tobacco product 1 described below is only illustrative and is not limited to the steps.

First, in the grinding step S1, a lamina and a midrib are respectively ground into tobacco microparticles equal to or smaller than 2 mm by a grinder. The tobacco microparticles are put in a classifier and classified into predetermined sizes. Thereafter, the tobacco microparticles after the classification are measured to respectively have, for example, part by weight ratios of 50%. The manufacturing process shifts to the blend step S2.

In the blend step S2, the tobacco microparticles after the measurement are transferred to a first buffer silo (not illustrated in the figure) and stored in the first buffer silo for a predetermined period. Thereafter, the tobacco microparticles in the first buffer silo are subjected to blender treatment through heat sterilization and cooling treatment. In the blender treatment, while the tobacco microparticles are mixed, perfume is added to the tobacco microparticles.

Specifically, after water is added to the tobacco microparticles first and an amount of moisture of the tobacco microparticles is adjusted to be a predetermined value, the tobacco microparticles are heated and subjected to heat treatment and sterilization treatment. Thereafter, the tobacco microparticles are cooled by circulating cooling water. After potassium carbonate, sodium chloride, or the like is mixed with the tobacco microparticles, for example, mint is added as the perfume. The manufacturing process shifts to the next packaging step S3. In the blend step S2, the amount of moisture of the tobacco microparticles is adjusted to a so-called low water content state of 12 to 15%. Note that these are illustrations, and the blend step S2 can be changed as appropriate, for example, potassium carbonate, sodium chloride, or the like is mixed before the heating, or glycerin serving as a moisturizing agent is mixed after the heating according to necessity.

In the packaging step S3, a mixture including the tobacco microparticles after undergoing the blend step S2 is stored in a second buffer silo (not illustrated in the figure) for a predetermined period. The mixture after the storage is pillow-packaged by a nonwoven fabric sheet by 0.3 g at a time. At this point, the pouch P described above is manufactured. Specifically, the pouch P is formed in a rectangular shape having the short side of about 12 mm and the long side of about 25 mm. The tobacco microparticles packaged in one pouch P is set as appropriate in a range of about 0.2 to 0.5 g. However, the shape and the size of the pouch P and the weight per one pouch P can be changed in design as appropriate.

Thereafter, the pouch P is housed in the package 2A that is in a state in which a predetermined amount of water is poured into the liquid storing section 24. Then, the opening portion of the package 2A is closed by the opening seal 22, whereby the oral tobacco product 1 illustrated in FIG. 1 is manufactured.

A suitable range of an amount of moisture (a moisture content) at the time when the pouch P (the SNUS) is put in the mouth of the user is relatively high at about 30 to 60%. The amount of moisture in smoking the SNUS is in a high water content state in this way because, in a low water content state with a relatively small amount of moisture, it takes long time until the tobacco component of the SNUS is extracted to the saliva of the user. Therefore, from the viewpoint of preventing emission of flavor from being excessively delayed, it is preferable that the amount of moisture is in the high water content state at a point when the pouch P is taken out from the package 2A.

However, in the manufacturing process for the pouch P, for example, the blend step S2, when the amount of moisture is changed to the high water content state, fluidity of the SNUS is deteriorated, causing deterioration in packaging efficiency of the SNUS and deterioration in production efficiency of the pouch P. In order to make it easy to package the SNUS with nonwoven fabric in the high water content state, a pre-treatment process for pressing and hardening the SNUS and the like is necessary, causing an increase in labor and time and causing damage to a sense of use by the user because the tobacco microparticles are pressed and hardened.

In order to prevent the inconveniences described above, it is also possible to conceive a method of manufacturing the pouch P in the low water content state in which the amount of moisture is relatively small and, thereafter, adding water to the surface of the pouch P, adjusting the amount of moisture to a desired amount of moisture suitable for the user to enjoy flavor of the SNUS, and shipping the pouch P. However, in this case, the pouch P is colored by seepage of a tobacco component in a distribution process for distributing the oral tobacco product 1, causing damage to the quality of external appearance d. Further, in order to distribute the pouch P in the high water content state as described above while maintaining quality thereof, it is necessary to arrange a cooling facility such as a refrigerator in a distribution route of the pouch P, easily leading to an increase in distribution costs.

Therefore, in many cases, the pouch P (the SNUS) manufactured in the low water content state in which treatment in the manufacturing process is easy and the cooling facility is unnecessary is directly provided to the user. However, in this case, there is a problem in that emission of flavor and a sense of use are deteriorated.

On the other hand, in the package 2A in this embodiment, the pouch P manufactured in the low water content state is housed in the pouch housing space 23 and the water for adjusting the amount of moisture of the pouch P is sealed in the liquid storing section 24. When enjoying flavor of the SNUS, the user breaks the liquid storing section 24 and causes the water stored in the liquid storing section 24 to penetrate into the pouch P to make it possible to change the pouch P (the SNUS) to the high water content state.

Figure 3:
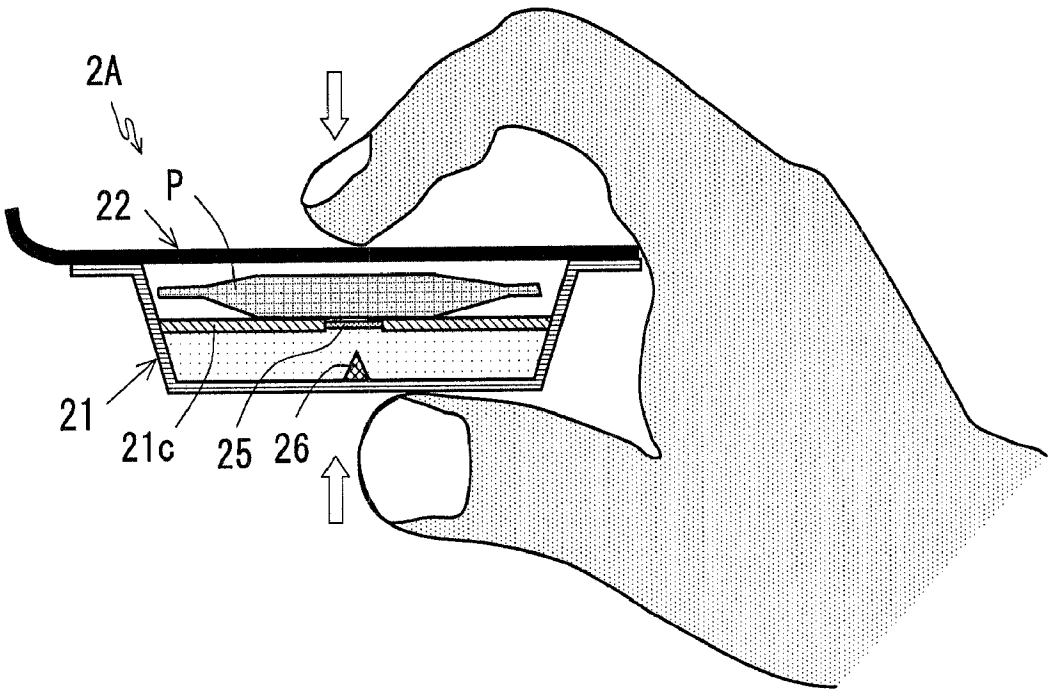
FIG. 3 is an explanatory diagram for explaining a method of causing water stored in a liquid storing section to penetrate into a pouch.

When taking out the pouch P from the package 2A, before peeling the opening seal 22, the user performs an operation described below to thereby open the liquid storing section 24 and cause the water stored in the liquid storing section 24 to penetrate into the pouch P. That is, as illustrated in FIG. 3, for example, the user holds the package 2A from above and below with the thumb and the index finger and applies a proper force to the bottom of the container main body 21 and the opening seal 22 to bend the bottom and the opening seal 22. The package 2A is deformed in this way, whereby the protrusion for cleavage 26 and the cleaving section 25 separated from each other come close to each other. As a result, the protrusion for cleavage 26 collides with the cleaving section 25 and the cleaving section 25 cleaves. Consequently, the water stored in the liquid storing section 24 is discharged and penetrates into the pouch P (the SNUS).

In the liquid storing section 24, a predetermined amount of water suitable for adjusting the amount of moisture of the pouch P to 30 to 60% is adjusted in advance and stored. For example, water of about 0.1 to 1.0 g is stored. Therefore, the water discharged from the liquid storing section 24 is added to the pouch P, whereby the pouch P changes from the low water content state to the high water content state. Note that a stored liquid amount (a water amount) of the liquid storing section 24 can be calculated on the basis of a setting value of an amount of moisture during manufacturing of the pouch P, the mass of the tobacco microparticles included in the pouch P, and the like.

After the pouch P changes to the high water content state, the user peels the opening seal 22 and opens the package 2A and holds the taken-out pouch P between the upper lip and the gum to enjoy flavor of the pouch P while absorbing the tobacco component. At that time, since the pouch P is in the high water content state at a point when the pouch P is put in the mouth of the user, a long time is not required for the tobacco component of the SNUS to be extracted in the saliva, and it is possible to moderately bring forward emission of flavor. Note that the pouch P after use can be housed in the package 2A again and discarded.

As described above, with the package 2A and the oral tobacco product 1 including the package 2A according to this embodiment, since the pouch P can be manufactured in the low water content state during manufacturing of the pouch P, it is possible to improve production efficiency of the pouch P. Further, seepage of the tobacco component to the nonwoven fabric less easily occurs because of the low water content state. When the pouch P is provided to the user, it is possible to prevent an impression concerning the external appearance of the pouch P from being deteriorated.

Since it is unnecessary to press and harden the SNUS during manufacturing, it is also possible to prevent a sense of use from being deteriorated when the user uses the SNUS.

Further, in the distribution process after the shipment as the oral tobacco product 1, since the pouch P is maintained in the low water content state, it is unnecessary to dispose a low-temperature storage facility in a distribution route of the pouch P and it is possible to reduce distribution costs. When the oral tobacco product 1 is served for use by the user, the water in the liquid storing section 24 is added to the pouch P by the user and the pouch P changes from the low water content state to the high water content state. Therefore, emission of flavor is excellent and it is possible to improve satisfaction of the user.

As described above, according to the present invention, concerning the oral tobacco product 1, it is possible to improve the quality of the oral tobacco product 1 such as an external appearance, a sense of use, and emission of flavor during provision to a user, although the oral tobacco product 1 is premised on manufacturing of the pouch P (the SNUS) in a low water content state in which treatment during manufacturing and during distribution is easy. Therefore, it is possible to collectively solve all of the problems concerning emission of flavor and a sense of use manifested because of a reduction in the amount of moisture of the pouch P (the SNUS) and the problems concerning manufacturing efficiency, an external appearance, and costs manifested because of an increase in the amount of moisture of the pouch P in the past.

Note that, in the configuration example illustrated in FIG. 1, the thickness of the cleaving section 25 in the partition wall 21*c*, which partitions the liquid storing section 24 and the pouch housing space 23, is formed thin in thickness thereof compared with the general portion. However, a material excellent in rupture properties compared with the other region may be used instead of or together with the cleaving section 25. In this embodiment, the protrusion for cleavage 26 that collides with the cleaving section 25 to cleave the cleaving section 25 and the cleaving section 25 correspond to the opening assisting section configured to assist opening of the liquid storing section in the present invention.

A form in which the liquid storing section 24 in this embodiment is integrally formed with the container main body 21 is illustratively described. However, the container main body 21 made of the impermeable material described above may be separately formed and arranged in the inside of the package 2A (in the first embodiment, on the bottom of the container main body 21). In the package 2A, a plurality of the protrusions for cleavage 26 may be provided. In that case, the cleaving section 25 may be formed in each of positions to which the respective protrusions for cleavage 26 are opposed in the partition wall 21*c* or, for example, the entire region of the partition wall 21*c* may be configured by the cleaving section 25.

In the package 2A in this embodiment, one pouch P is housed in the pouch housing space 23 thereof. However, a plurality of the pouches P may be housed. In that case, a stored amount of the water stored in the liquid storing section 24 is desirably adjusted according to the number of the housed pouches P such that the respective pouches P have appropriate amounts of moisture.

As the liquid stored in the liquid storing section 24, water is adopted in the configuration example described above. However, the liquid may be a solution obtained by adding and dissolving perfume and other additives in a solvent (hereinafter referred to as perfume liquid). As the perfume, menthol, mint, vanilla, apricot, tea, cocoa, licorice, honey, and the like can be used alone or in combination of a plurality thereof. Here, as the solvent, water, alcohol, glycerin, propylene glycol, and the like can be used. Consequently, the perfume liquid penetrates into the nonwoven fabric and the SNUS forming the pouch P immediately before the user uses the SNUS. Therefore, it is possible to provide the user with fresh flavor.

A variation of a package for the oral tobacco product 1 according to this embodiment is described below.

Second Embodiment

Figure 4:
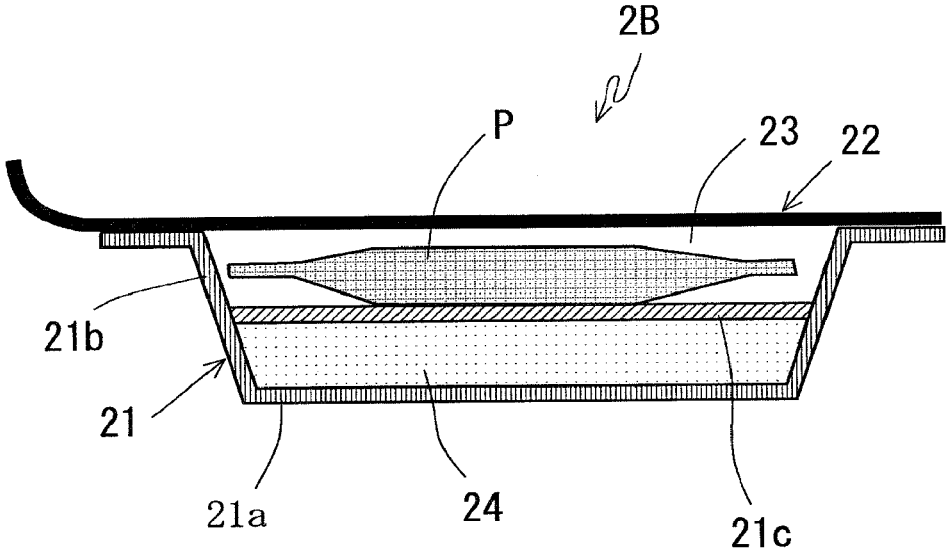
FIG. 4 is a schematic configuration diagram schematically illustrating a second package related to an oral tobacco product.

FIG. 4 is a schematic configuration diagram schematically illustrating a sectional shape of a second package 2B related to an oral tobacco product. The package 2B in this embodiment is an example in which the structure thereof is further simplified compared with the package 2A illustrated in FIG. 1. The package 2B is different from the package 2A according to the first embodiment in that the cleaving section 25 and the protrusion for cleavage 26 are not provided.

Here, when a user causes water or perfume liquid stored in the liquid storing section 24 to penetrate into the pouch P, as in the first embodiment, the user holds the package 2B from above and below with the thumb and the finger and applies force to the fingertips. Such an action by the user is hereinafter referred to as "package crushing action".

Consequently, the liquid storing section 24 is crushed through the bottom of the container main body 21 and the opening seal 22. As a result, the partition wall 21*c* forming the liquid storing section 24 ruptures. As a result, the water or the perfume liquid stored in the liquid storing section 24 can be added to the pouch P and caused to penetrate into the pouch P.

Note that, concerning this embodiment, because setting of the protrusion for cleavage 26 is omitted, it is desirable to adjust in advance the thickness, the strength, and the like of the liquid storing section 24 such that the liquid storing section 24 ruptures with a pressing force applied to the liquid storing section 24 by the user.

Third Embodiment

Figure 5:
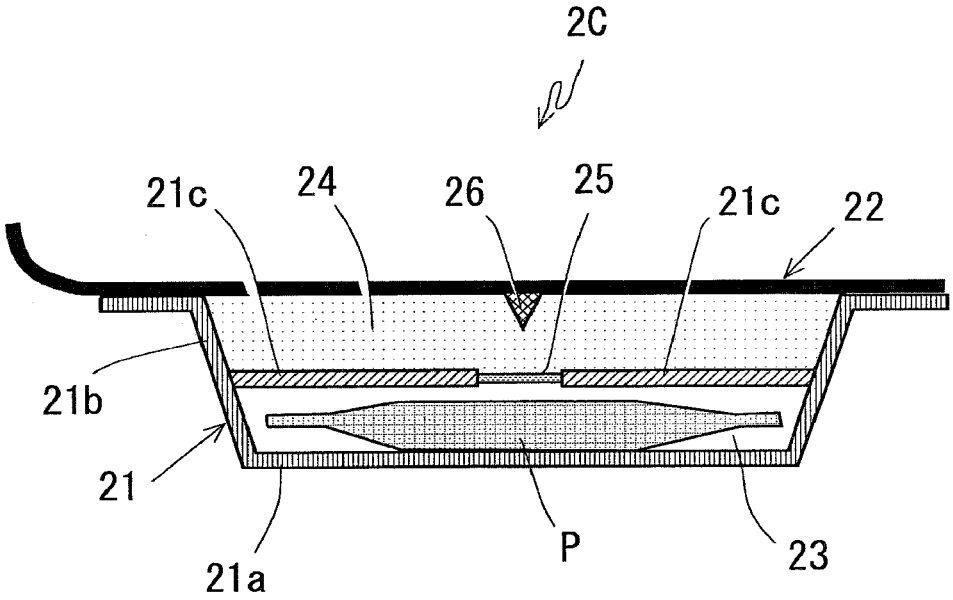
FIG. 5 is a schematic configuration diagram schematically illustrating a third package related to an oral tobacco product.

Next, a third package 2C according to a third embodiment is described. FIG. 5 is a schematic configuration diagram schematically illustrating a sectional shape of the third package 2C related to an oral tobacco product. In the package 2C, the pouch housing space 23 is formed on the bottom side of the container main body 21 and the liquid storing section 24 is formed above the pouch housing space 23.

Specifically, the liquid storing section 24 is integrally formed on the rear side of the opening seal 22. The protrusion for cleavage 26 is provided on the rear side of the opening seal 22. The tip portion of the protrusion for cleavage 26 is formed downward. In a position opposed to the protrusion for cleavage 26 in the partition wall 21*c* which partitions the liquid storing section 24 and the pouch housing space 23, the cleaving section 25 which is formed thinner in thickness than the other region or more easily ruptures (has more excellent rupture properties) than the other region is formed.

In the package 2C configured in this way, as in the package 2A according to the first embodiment, the protrusion for cleavage 26 collides with the cleaving section 25 and the cleaving section 25 ruptures according to the package crushing action by the user. As a result, the water or the perfume liquid stored in the liquid storing section 24 is added to the pouch P and an amount of moisture of the pouch P can be increased. Therefore, a sense of use and emission of flavor of the SNUS are improved.

Forth Embodiment

Figure 6:
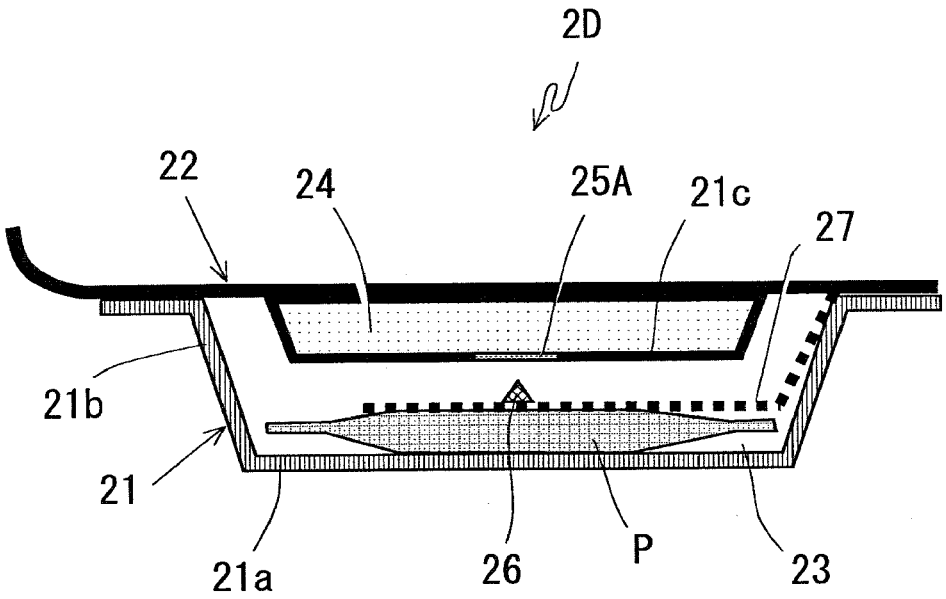
FIG. 6 is a schematic configuration diagram schematically illustrating a fourth package related to an oral tobacco product.

Next, a fourth package 2D according to a fourth embodiment is described. FIG. 6 is a schematic configuration diagram schematically illustrating a sectional shape of the fourth package 2D related to an oral tobacco product. The liquid storing section 24 in the package 2D is a bag-like container formed using an impermeable material and is integrally formed on the rear surface of the opening seal 22. In the package 2D in this embodiment, as in the package 2C according to the third embodiment, the pouch housing space 23 is formed on the bottom side of the container main body 21 and the liquid storing section 24 is formed above the pouch housing space 23.

A protrusion forming sheet 27 on which the protrusion for cleavage 26 is formed is arranged between the liquid storing section 24 and the pouch housing space 23. A proximal end side of the protrusion forming sheet 27 extends from the vicinity of an upper end opening edge of the container main body 21. A distal end side of the protrusion forming sheet 27 forms a free end while providing a gap between the distal end and the sidewall 21*b*. As illustrated in the figure, on the upper surface (a surface facing the liquid storing section 24) of the protrusion forming sheet 27, the protrusion for cleavage 26 pointed toward the liquid storing section 24 is set.

Such the protrusion forming sheet 27 is placed on the pouch P, whereby the protrusion for cleavage 26 is arranged with a predetermined gap opened between the protrusion for cleavage 26 and the liquid storing section 24. In a region opposed to the protrusion for cleavage 26 in the partition wall 21*c* forming the liquid storing section 24, a cleaving section 25A excellent in rupture properties compared with the other region is formed.

Also in the package 2D having the configuration described above, a user performs the package crushing action described above before taking out the pouch P from the package 2A. Then, as in the embodiments described above, the protrusion for cleavage 26 approaches the cleaving section 25A. As a result, the cleaving section 25A cleaves, whereby the liquid storing section 24 is opened and the liquid in the inside thereof is discharged.

Here, since a gap is provided between the distal end of the protrusion forming sheet 27 and the sidewall 21*b* in the case main body 21, the water or the perfume liquid discharged from the liquid storing section 24 is supplied to the pouch P through the gap. As a result, since an amount of moisture of the pouch P increases, it is possible to improve emission of flavor in the SNUS.

Fifth Embodiment

Figure 7:
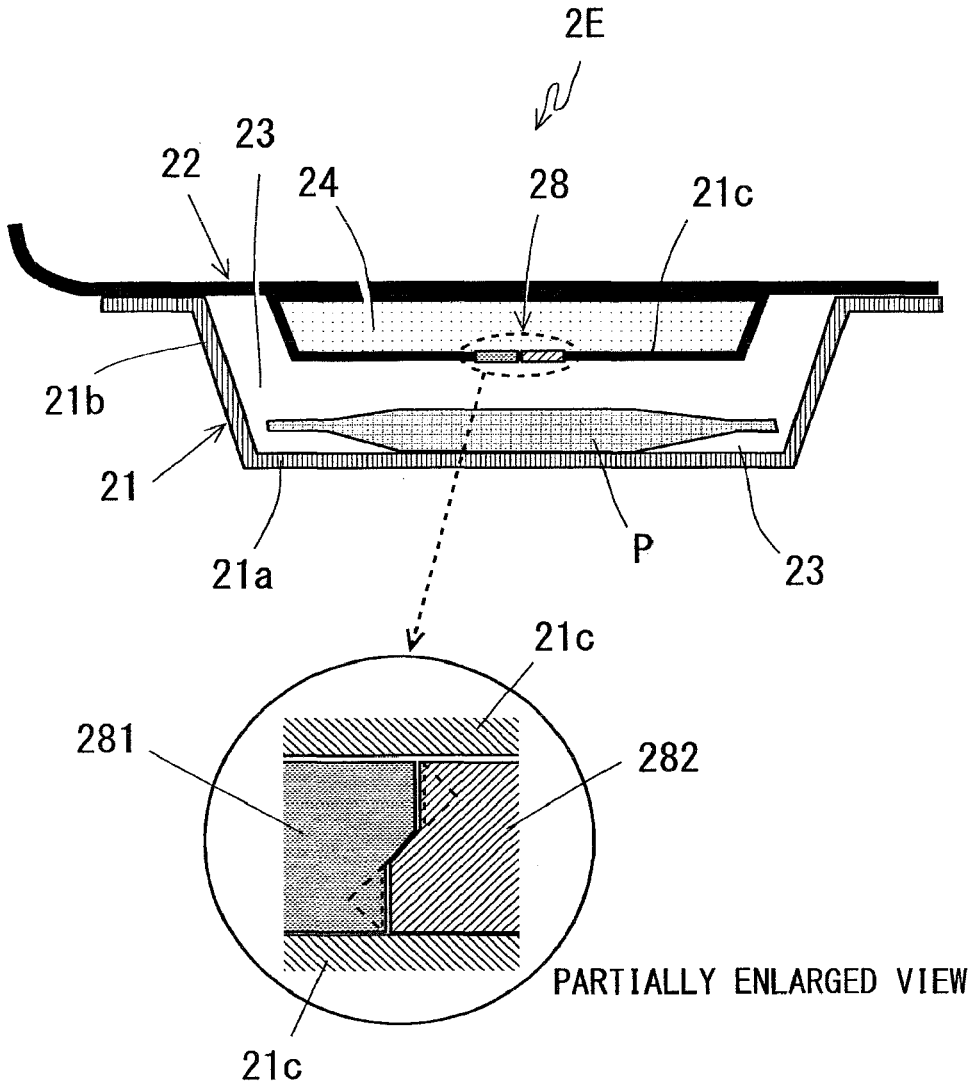
FIG. 7 is a schematic configuration diagram schematically illustrating a fifth package related to an oral tobacco product.

Next, a fifth package 2E according to a fifth embodiment is described. FIG. 7 is a schematic configuration diagram schematically illustrating a sectional shape of the fifth package 2E related to an oral tobacco product. In the package 2E, as in the package 2C according to the third embodiment, the pouch housing space 23 for housing the pouch P is formed on the bottom side of the container main body 21. The liquid storing section 24 is formed above the pouch housing space 23.

In the package 2E in this embodiment, a meshing seal section 28 is provided in the partition wall 21*c* as an opening assisting section for assisting opening of the liquid storing section 24.

In FIG. 7, a partially enlarged view of the meshing seal section 28 is also illustrated. As illustrated in the figure, the meshing seal section 28 is a seal structure including a first meshing piece 281 and a second meshing piece 282 that mesh with each other. More specifically, one convex portion and one concave portion are formed on each of the distal end sides of the first meshing piece 281 and the second meshing piece 282. The convex portion and the concave portion on the first meshing piece 281 side are respectively engaged with the concave portion and the convex portion on the second meshing piece 282 side. The convex portions and the concave portions are bonded to each other. Therefore, the inside of the liquid storing section 24 and the pouch housing space 23 are liquid-tightly shut off.

The first meshing piece 281 and the second meshing piece 282 have a certain degree of rigidity. When a user performs the package crushing action, a twisting force acts on the first meshing piece 281 and the second meshing piece 282. As a result, the bonding of the first meshing piece 281 and the second meshing piece 282 is cut and mechanical meshing of the convex portions and the concave portions is released, whereby the liquid storing section 24 is opened. Consequently, it is possible to cause the water or the perfume liquid stored in the inside of the liquid storing section 24 to penetrate into the pouch P.

Sixth Embodiment

Figure 8:
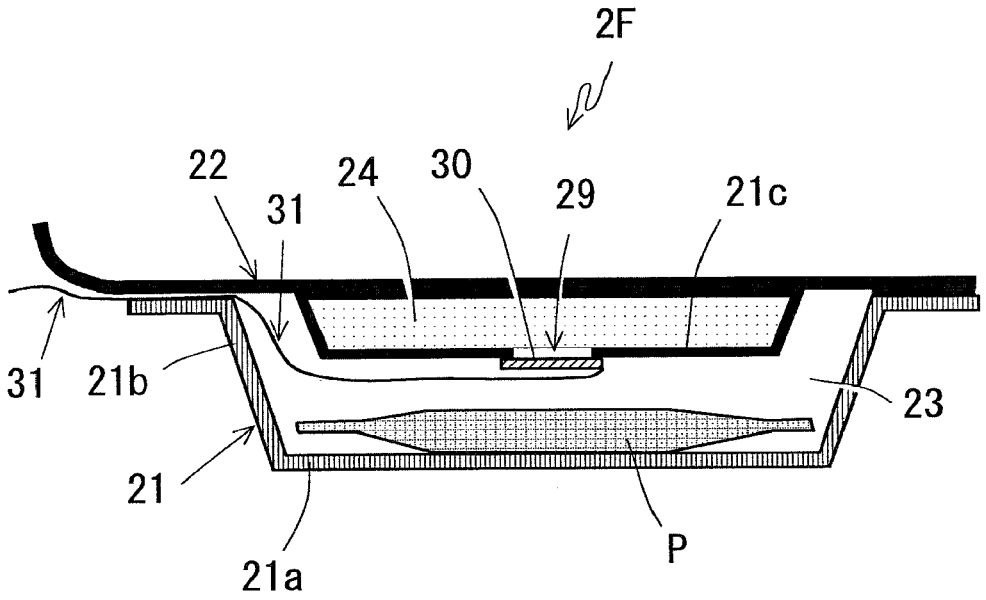
FIG. 8 is a schematic configuration diagram schematically illustrating a sixth package related to an oral tobacco product.

Next, a sixth package 2F according to a sixth embodiment is described. FIG. 8 is a schematic configuration diagram schematically illustrating a sectional shape of the sixth package 2F related to an oral tobacco product. In the package 2F, a water feeding hole 29 is opened in a part of the liquid storing section 24. The water feeding hole 29 is liquid-tightly closed by a sealing seal 30. In an example illustrated in the figure, since the liquid storing section 24 is arranged above the pouch housing space 23 in which the pouch P is housed, the water feeding hole 29 is provided below the liquid storing section 24.

The proximal end of a pulling cord 31 is connected to the sealing seal 30. The distal end side of the pulling cord 31 is exposed to the outside of the package 2F while being held between the upper end opening edge of the container main body 21 and the opening seal 22.

When taking out the pouch P from the package 2F, the user pulls the pulling cord 31 in advance to peel the sealing seal 30 connected to the pulling cord 31 from the liquid storing section 24. Then, since the water feeding hole 29 is opened, the water or the perfume liquid stored in the inside of the liquid storing section 24 can be added to the pouch P and an amount of moisture of the pouch P can be increased.

Note that, in this embodiment, the sealing seal 30 and the pulling cord 31 correspond to the opening assisting section in the present invention. As the sealing seal 30, for example, an adhesive seal can be suitably used. However, various seals can be adopted as long as the water feeding hole 29 can be liquid-tightly sealed. The position where the water feeding hole 29 is formed can be changed as appropriate.

Seventh Embodiment

Figure 9:
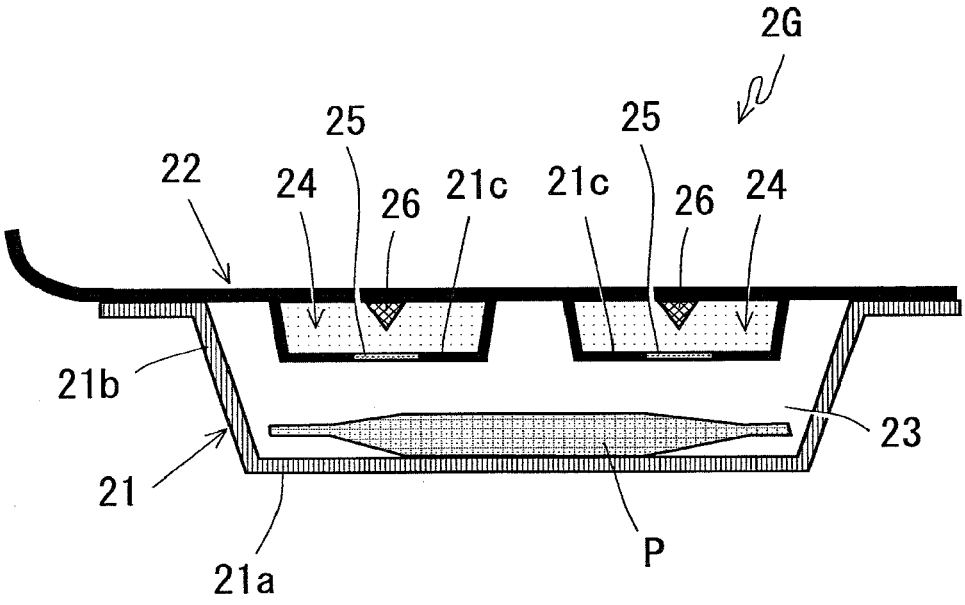
FIG. 9 is a schematic configuration diagram schematically illustrating a seventh package related to an oral tobacco product.

Next, a seventh package 2G according to a seventh embodiment is described. FIG. 9 is a schematic configuration diagram schematically illustrating a sectional shape of the seventh package 2G related to an oral tobacco product. The package 2G is different from the embodiments described above in that a plurality of the liquid storing sections 24 are provided in the container main body 21. The package 2G is the same as the package 2C according to the third embodiment in other points, for example, in that the cleaving section 25 is formed in the partition wall 21*c* forming a part of the liquid storing section 24 and that the protrusion for cleavage 26 for cleaving the cleaving section 25 is provided. However, the technical idea that the plurality of liquid storing sections 24 are provided, which is a characteristic point of this embodiment, can also be applied to the configurations according to all the embodiments described above.

In an example illustrated in the figure, the package 2G includes two liquid storing sections 24. In each of the liquid storing sections 24, a predetermined amount of water is measured in advance and stored. In this way, with the package 2G, since the plurality of liquid storing sections 24 for storing water for adjusting humidity of the pouch P are provided, a user can change, as appropriate, the number of the liquid storing sections 24 to be ruptured (the number of the liquid storing sections 24 to be opened). Consequently, the user can adjust an addition amount of the water added to the pouch P. Therefore, the user can adjust time duration until emission of flavor when the user takes in the SNUS.

For example, when the user prefers gentle emission of flavor, the user desirably crushes only one liquid storing section 24. Consequently, since an amount of moisture of the pouch P (the SNUS) moderately increases, it is possible to properly shorten time duration until emission of flavor.

On the other hand, when the user prefers steep emission of flavor, the user desirably crushes two liquid storing sections 24 and adds the water stored in both the liquid storing sections 24 to the pouch P. Consequently, it is possible to further increase the amount of moisture of the pouch P (the SNUS). Therefore, it is possible to shorten time duration until emission of flavor compared with the time duration until emission of flavor in the case of the gentle emission of flavor.

As described above, with the package 2G according to this embodiment, it is possible to adjust humidity of the pouch P (the SNUS) according to preference of the user. Note that, naturally, three or more liquid storing sections 24 may be housed in the package 2G. A degree of freedom of the user for selecting, according to preference, the number of the liquid storing sections 24 used for adjusting humidity of the pouch P (the SNUS) increases.

Here, a modification of this embodiment is described with reference to FIG. 9. In this modification, water is stored in at least one of the plurality of liquid storing sections 24 and perfume liquid is stored in at least one of the remaining liquid storing sections 24. In FIG. 9, since the two liquid storing sections 24 are provided, in this modification, one of the liquid storing sections 24 is filled with water, and the other is filled with the perfume liquid.

With this configuration, the user can select, according to preference or a mood thereof, which of the liquid storing sections 24 is crushed. That is, the user can freely select, in adjusting humidity of the pouch P (the SNUS), whether the water is simply added or the perfume liquid is added. Therefore, the user can not only adjust humidity of the pouch P (the SNUS) but also arrange flavor of the pouch P according to preference.

Note that, when the plurality of liquid storing sections 24 are provided in the inside of the package 2G as described above, for each of the liquid storing sections 24, an opening assisting section corresponding to the liquid storing section 24 is desirably provided. In an example illustrated in FIG. 9, the protrusions for cleavage 26 for assisting opening of the respective liquid storing sections 24 are provided to correspond to the respective liquid storing sections 24. In positions opposed to the respective protrusions for cleavage 26 in the partition walls 21*c* forming a part of the liquid storing sections 24, the cleaving sections 25 for assisting opening of the liquid storing sections 24 in cooperation with the protrusions for cleavage 26 are formed.

Note that, as the opening assisting sections for assisting opening of the liquid storing sections 24, instead of the protrusions for cleavage 26 and the cleaving sections 25, the meshing seal section 28 described in the fifth embodiment may be adopted or a combination of the sealing seal 30 and the pulling cord 31 described in the sixth embodiment may be adopted.

[Type of the Package]

Figure 10:
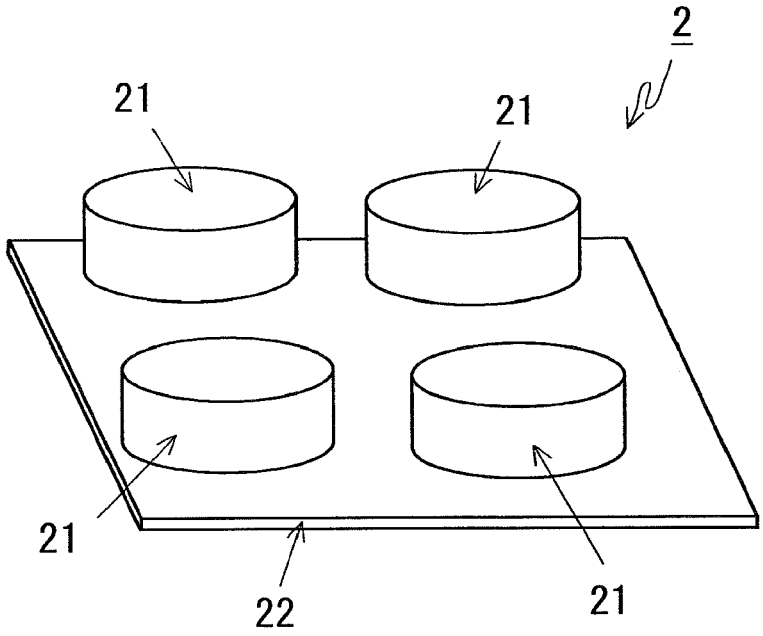
FIG. 10 is a perspective view illustrating a package of a blister type.

In the package of the blister type illustrated in FIGS. 1 to 9, one tray (the concave section) forming the pouch housing space 23 for housing the pouch P, i.e., one container main body 21 is provided. However, as illustrated in FIG. 10, the package 2 may include a plurality of the container main bodies 21 (concave sections). Needless to say, such a form of the package 2 can be suitably applied to the packages described in all the embodiments above. The package 2 related to the oral tobacco product of the preset invention is not limited to the blister type, and various forms such as a pillow type and a can type can be adopted.

Eighth Embodiment

Figure 11:
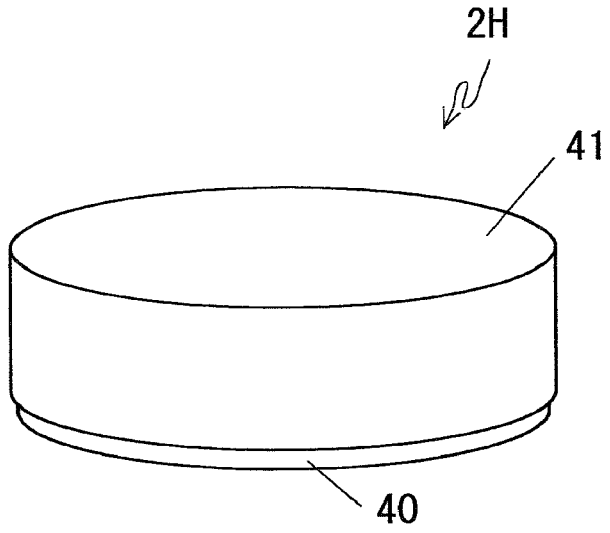
FIG. 11 is a perspective view of an eighth package related to an oral tobacco product.
Figure 12:
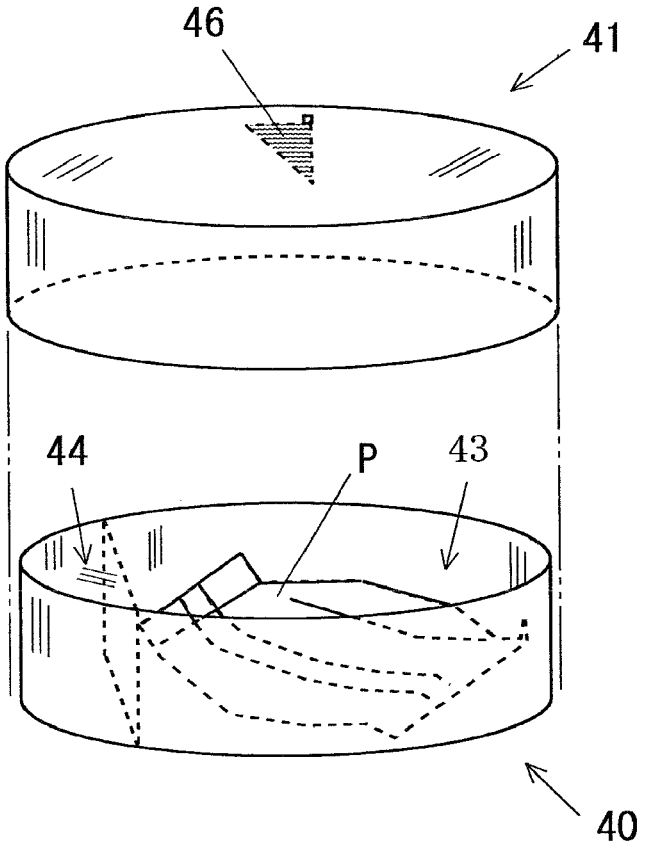
FIG. 12 is an exploded perspective view of the eighth package related to an oral tobacco product.

Next, an eighth package 2H according to an eighth embodiment is described. FIG. 11 is a perspective view of the eighth package 2H related to an oral tobacco product. FIG. 12 is an exploded perspective view of the eighth package 2H.

The package 2H is a package of a so-called can type. The package 2H includes a container main body 40 having a bottomed cylindrical shape and a cap member 41. The external shape of the package 2G is defined by the container main body 40 and the cap member 41. The inner diameter of the cap member 41 is designed slightly larger than the outer diameter of the container main body 40. The cap member 41 can be mounted rotatably relative to the container main body 40. When the cap member 41 is put on the container main body 40, the upper opening portion of the container main body 40 is covered.

In the inside of the container main body 40, a pouch housing space 43 for housing the pouch P and a liquid storing section 44 for storing water or perfume liquid are provided independently from each other. Like the liquid storing section 24 described above, the liquid storing section 44 is formed using the impermeable material and has liquid tightness. Here, respective functions of the pouch housing space 43 and the liquid storing section 44 are the same as the functions of the pouch housing space 23 and the liquid storing section 24 according to the embodiments described above.

On the other hand, the cap member 41 includes a protrusion for cleavage 46 projected from the ceiling inner wall surface of the cap member 41. Like the protrusion for cleavage 26 described above, the protrusion for cleavage 46 functions as an opening assisting section for assisting opening of the liquid storing section 44. In an example illustrated in the figure, the protrusion for cleavage 46 projects from the inner circumferential surface of the cap member 41. A pointed tip portion of the protrusion for cleavage 46 is directed in the inner circumferential direction of the cap member 41.

Figure 13:
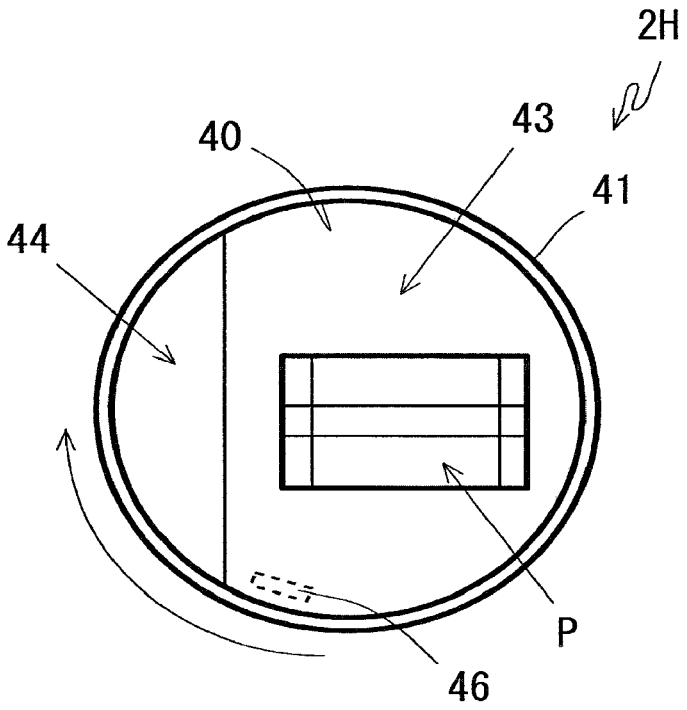
FIG. 13 is a diagram illustrating a planar relative positional relation between a container main body and a cap member in an initial state of the eighth package.

FIG. 13 is a diagram illustrating a planar relative positional relation between the container main body 40 and the cap member 41 in an initial state of the package 2H. The initial state is, for example, a state during shipment of the oral tobacco product 1, i.e., a state before the oral tobacco product 1 is provided to a user.

As illustrated in the figure, in the initial state, the protrusion for cleavage 46 is arranged to face the pouch housing space 43 in the container main body 40.

Before taking out the pouch P from the package 2H, the user twists the cap member 41 in an arrow direction in the figure to thereby relatively rotate the cap member 41 and the container main body 40. Then, as is evident from FIG. 13, the protrusion for cleavage 46 approaches the liquid storing section 44. When the protrusion for cleavage 46 and the liquid storing section 44 collide with each other, the liquid storing section 44 cleaves. As a result, the water or the perfume liquid stored in the liquid storing section 44 is supplied to the pouch P.

Thereafter, the user can taste flavor of the SNUS by removing the cap member 41 from the container main body 40, taking out the pouch P after humidity adjustment from the container main body 40, and holding the pouch P in the mouth. At that time, since the pouch P (the SNUS) is in a high water content state, emission of flavor is excellent. Consequently, it is possible to improve satisfaction of the user.

Note that, also in the package 2H in this embodiment, a plurality of the liquid storing sections 44 may be provided in the inside thereof. In the liquid storing section 44, in a region where the protrusion for cleavage 46 collides when the user rotates the cap member 41 relative to the container main body 40, a cleaving section that easily cleaves compared with the other region may be formed.

In the cap member 41 and the container main body 40 in the package 2H, for example, a resin material generally used as a food packaging material and the like can be suitably used. Further, the inside of the package 2H may be filled with an inert gas. The filling with the inert gas can be applied to not only the package according to this embodiment but also the packages according to all the embodiments described above.

In the package 2H in this embodiment, in the initial state illustrated in FIG. 13, a structure may be adopted in which the cap member 41 cannot be lifted even if the cap member 41 is pulled directly upward, i.e., in a direction separating from the container main body 40, and the cap member 41 can be removed from the container main body 40 only after the container main body 40 and the cap member 41 are rotated relative to each other. This is convenient because, when the package 2H is opened, the liquid stored in the liquid storing section 44 is already supplied to the pouch P (the SNUS).

The container main body 40 and the cap member 41 may be provisionally fixed to each other via a provisional fixing member for retaining the relative position in the initial state. Consequently, it is possible to prevent a situation in which the cap member 41 undesirably rotates with respect to the container main body 40 because of a vibration, a shock, or the like received in a distribution process of the product, and the liquid inside is discharged from the liquid storing section 44 by the protrusion for cleavage 46.

The preferred embodiments of the present invention are described above. However, the oral tobacco product and the package applied to the oral tobacco product according to the present invention are not limited to the embodiments and can include combinations of the embodiments as much as possible. In the embodiments described above, it goes without saying that various changes can be made without departing from the spirit of the present invention.

This application is a continuation application of International Application PCT/JP2011/058252 filed on Mar. 31, 2011 and designated the U.S., the entire contents of which are incorporated herein by reference.

What is claimed is:

1. A package for an oral tobacco product, the package housing in a housing space, a tobacco packaging body, including tobacco microparticles made of a tobacco raw material, and a packaging material for packaging the tobacco microparticles, the package further comprising, in an inside thereof, a liquid storing section defining a closed and sealed space separate from the housing space of the tobacco packaging body, and adapted to supply a liquid to the tobacco packaging body.

2. The package for the oral tobacco product according to claim 1, wherein the package includes a plurality of the liquid storing sections.

3. The package for the oral tobacco product according to claim 2, wherein water is stored in at least one of the plurality of liquid storing sections and perfume liquid obtained by dissolving perfume in a solvent is stored in at least one of the remaining liquid storing sections.

* * * * *